US006456688B1

(12) United States Patent
Taguchi et al.

(10) Patent No.: US 6,456,688 B1
(45) Date of Patent: Sep. 24, 2002

(54) X-RAY SPECTROMETER AND APPARATUS FOR XAFS MEASUREMENTS

(75) Inventors: Takeyoshi Taguchi, Tachikawa; Noboru Osawa, Hachioji; Kazuyuki Tohji, Sendai, all of (JP)

(73) Assignee: Rigaku Corporation, Tokyo (JP)

( * ) Notice: Subject to any disclaimer, the term of this patent is extended or adjusted under 35 U.S.C. 154(b) by 37 days.

(21) Appl. No.: 09/643,780

(22) Filed: Aug. 22, 2000

(30) Foreign Application Priority Data

Aug. 26, 1999 (JP) ..... 11-239112

(51) Int. Cl.[7] ..... G21K 1/06

(52) U.S. Cl. ..... 378/84; 378/79; 378/80; 378/81

(58) Field of Search ..... 378/84, 70, 71, 378/79, 82, 81

(56) References Cited

U.S. PATENT DOCUMENTS 4,637,041 A * 1/1987 Brinkgreve et al. ..... 378/71

FOREIGN PATENT DOCUMENTS

| | | |
|---|---|---|
| JP | 4-370748 | 12/1992 |
| JP | 6-66736 | 3/1994 |
| JP | 6-66738 | 3/1994 |
| JP | 5-151089 | 5/1994 |
| JP | 6-313757 | 11/1994 |
| JP | 6-317545 | 11/1994 |

* cited by examiner

*Primary Examiner*—Robert H. Kim
*Assistant Examiner*—Courtney Thomas
(74) *Attorney, Agent, or Firm*—Frishauf, Holtz, Goodman & Chick, P.C.

(57) ABSTRACT

An X-ray spectrometer having a curved crystal monochromator which diffracts a continuous X-ray beam from an X-ray source to produce a monochromatic X-ray beam. An angle of incidence of the continuous X-ray beam can be changed with respect to the monochromator so as to change the wavelength of the monochromatic X-ray beam which is focused on and taken out from a receiving slit. The X-ray source, the monochromator and the receiving slit must be positioned always on a Rowland circle. The X-ray source and the monochromator can be moved so that the angle of incidence changes, while the receiving slit remains always stationary and the direction of an X-ray path from the center of the monochromator to the receiving slit remains always constant. Such an X-ray spectrometer is usable as an X-ray irradiation system of XAFS (X-ray Absorption Fine Structure) apparatus so that XAFS measurements require no movement of the sample.

7 Claims, 8 Drawing Sheets

X-RAY SPECTROMETER AND APPARATUS FOR XAFS MEASUREMENTS

BACKGROUND OF THE INVENTION

This invention relates to an X-ray spectrometer having a curved crystal monochromator which diffracts a continuous X-ray beam to produce a monochromatic X-ray beam of a different desired wavelength which can be changed. More particularly, this invention relates to apparatus for performing XAFS (X-ray Absorption Fine Structure) measurements using such an X-ray spectrometer.

The XAFS apparatus can measure a fine structure of an X-ray absorption spectrum around the X-ray absorption edge of a sample material. The XAFS method is classified to EXAFS (Extended X-ray Absorption Fine Structure) and XANES (X-ray Absorption Near Edge Structure). The EXAFS is defined as a fine structure of absorption observed over a wide energy range, about 1 keV wide, higher than the X-ray absorption edge of a sample material, as well known in the art. On the other hand, the XANES is defined as a fine structure of absorption appearing in a narrower region near the X-ray absorption edge, i.e., within a range of about ±50 eV of the edge, which is becoming recently an noticeable technique. The XANES measurements can be carried out using the same apparatus as the EXAFS apparatus, therefore the name of "XAFS apparatus" has recently been used, instead of "EXAFS apparatus", because the XAFS apparatus can perform both the XANES and EXAFS measurements. An X-ray spectrometer according to the present invention is usable for the XAFS apparatus.

The XAFS apparatus can diffract a continuous X-ray beam, with the use of a crystal monochromator, to produce a monochromatic X-ray beam of a different desired wavelength, and can measure X-ray absorption coefficients of a sample for various wavelengths. The crystal monochromator may be usually a curved crystal monochromator for obtaining higher intensities.

In the XAFS apparatus using the curved crystal monochromator, an X-ray source, the curved reflective surface of the monochromator and a receiving slit, disposed before a sample, are to be positioned always on a Rowland circle. The wavelength of a monochromatic X-ray beam focused on the sample changes as the angle of incidence of the source X-ray beam changes with respect to the monochromator. During a change of the angle of incidence, the three components described above must be positioned always on the Rowland circle. The XAFS apparatus of this type is disclosed, for example, in Japanese patent publication Nos. JP 4-370748 A (1992), JP 6-66736 A (1994) and JP 6-313757 A (1994), noting that these publications use the name of "EXAFS apparatus".

In the field of the XAFS apparatus using the curved crystal monochromator, there have been developed various improvements on the movement control mechanism for positioning the X-ray source, the monochromator and the receiving slit always on the Rowland circle. Ordinary XAFS apparatus has the Rowland circle within a horizontal plane. On the other hand, a special XAFS apparatus has the Rowland circle within a vertical plane for liquid sample measurements, which is disclosed in, for example, Japanese patent publication Nos. JP 6-66738 A (1994) and JP 6-317545 A (1994).

In the field of the XAFS apparatus using the curved crystal monochromator, there is no apparatus, as far as the inventors know, in which the sample remains perfectly stationary during measurements of X-ray absorption spectra.

In the prior-art XAFS apparatus, when the above-described three components change in relative positions for a change of the wavelength of a monochromatic X-ray beam focused on the sample, the position of the receiving slit and/or the direction of an X-ray beam travelling from the monochromator to the receiving slit are to change. In this case, the position and/or the direction of the sample, disposed behind the receiving slit, are to change. Some samples, however, require to be stationary and therefore the prior-art XAFS apparatus has not been usable such a sample.

Further, measurements for liquid samples would have special requirements. The above-mentioned prior-art XAFS apparatus for the liquid samples has an improved mechanism of movement control so as to hold the posture of a vessel for liquid samples always in the horizontal position, provided that the vessel for liquid samples is under a translational movement. While the improved mechanism has the advantage of maintaining the horizontal position of the vessel, it has a disadvantage that the angle of incidence of an X-ray beam focused on the liquid surface changes as the wavelength of the X-ray beam changes, resulting in a change of the irradiated area size on the liquid surface. It has also another disadvantage that the liquid surface would wave when the liquid sample translates.

SUMMARY OF THE INVENTION

Accordingly it is an object of the invention to provide an X-ray spectrometer which can produce a monochromatic X-ray beam of a desired wavelength with a receiving slit remaining stationary.

It is another object of the invention to provide apparatus for XAFS measurements including an X-ray irradiation system consisting of an X-ray spectrometer and an X-ray measurement system having two X-ray detectors, wherein the two systems can be managed independently.

An X-ray spectrometer according to this invention comprises an X-ray source; a curved crystal monochromator; a receiving slit; and a movement control mechanism in which the angle of incidence of a continuous X-ray beam from the X-ray source can be changed with respect to the monochromator so that a monochromatic X-ray beam of a different desired wavelength is focused on and taken out from the receiving slit, provided that the X-ray source, the monochromator and the receiving slit must be positioned always on a Rowland circle. In the spectrometer, the X-ray source and the curved crystal monochromator can be moved so that said angle of incidence changes while the receiving slit remains stationary. Even when the angle of incidence of the X-ray beam changes with respect to the monochromator, the receiving slit remains always stationary and the direction of an X-ray path from the center of the curved crystal monochromator to the receiving slit remains always constant. Using this movement control mechanism, a monochromatic X-ray beam is taken out from the receiving slit, which is always at the same position, with the constant direction even when the wavelength of the taken-out X-ray beam changes. The X-ray spectrometer is usable as an X-ray irradiation system of XAFS apparatus, so that XAFS measurements require no movement of the sample and no movement of the X-ray detectors and therefore the X-ray irradiation system and the X-ray measurement system of the XAFS apparatus can be managed independently.

The X-ray spectrometer of this invention has a Rowland circle which can be arranged within a vertical plane. In this case, an X-ray source movement mechanism and a curved crystal monochromator movement mechanism can be supported by a horizontal long base which is positioned below the two movement mechanisms. With this support structure, the X-ray spectrometer can be compact as compared with the prior-art X-ray spectrometer which has a movement control mechanism supported by a comparatively large baseplate parallel to the Rowland circle. Using the support structure of this invention, the spectrometer includes a horizontal first slide which slides along first guide rail means fixed on the base, as a movement mechanism for monochromator; and a post pivotally mounted on the first slide and a second slide which slides along second guide rail means fixed to the post, as a movement mechanism for X-ray source. The curved crystal monochromator is set so as to move along with the first slide and the X-ray source is fixed to the second slide.

DETAILED DESCRIPTION OF THE PREFERRED EMBODIMENTS

Figure 1:
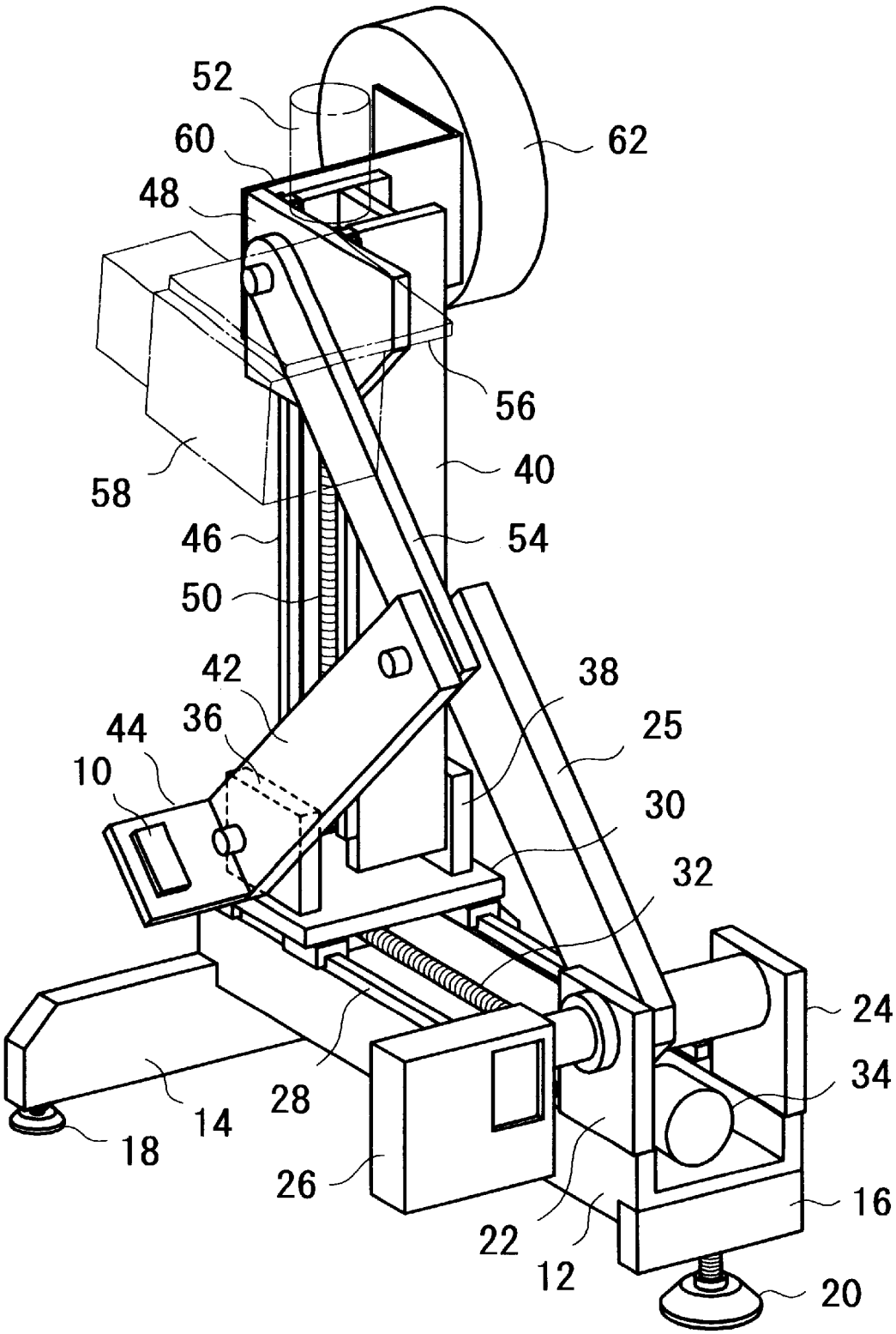
FIG. 1 is a perspective view showing an embodiment of the X-ray spectrometer according to this invention.
Figure 2:
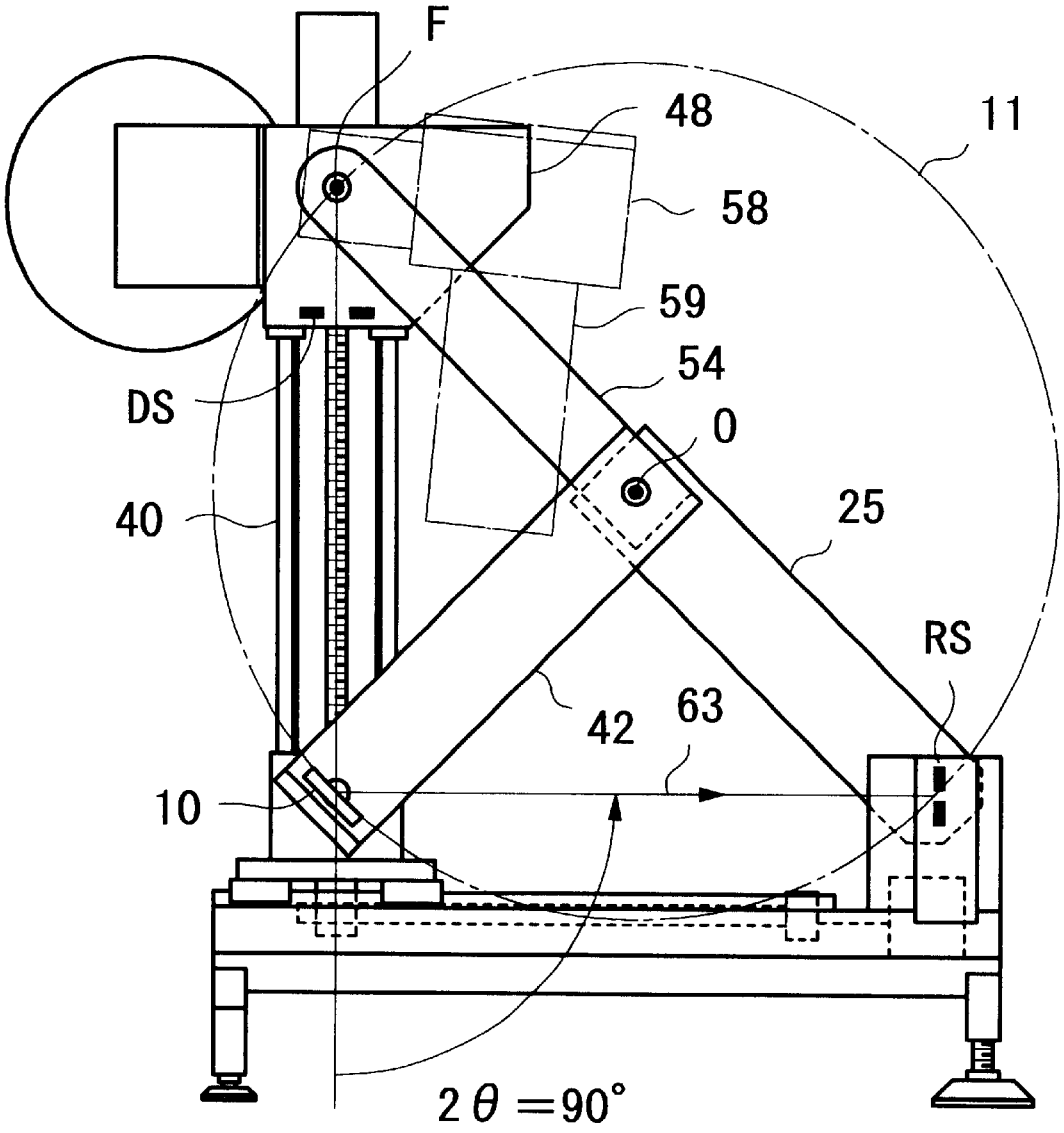
FIG. 2 is an elevation view of the X-ray spectrometer shown in FIG. 1.

Referring to FIGS. 1 and 2, an X-ray spectrometer has a curved crystal monochromator 10 and a Rowland circle 11 (FIG. 2) arranged within a vertical plane. Almost all the weight of the X-ray spectrometer is supported, as well shown in FIG. 1, by a base 12 arranged at the bottom of the spectrometer. The long base 12 has a U-shaped cross section and extends horizontally. The both ends of the base 12 are supported by a first support plate 14 and a second support plate 16. The first support plate 14 extends transversely, perpendicularly to the base 12, and has the both ends supported by a pair of first support legs 18, only one of which appears in FIG. 1. The second support plate 16 has the same width as the base 12 and is supported by one second support leg 20 which engages, at its threaded shaft, with the second support plate 16 to be adjustable in height to set the base 12 horizontally.

The base 12 has one end having its top surface on which a pair of first brackets 22 and 24 are fixed. To the brackets 22 and 24 is pivotally connected a first arm 25 at its bottom. A slit box 26 is fixed to and extends from the front-side first bracket 22, i.e., the left side in FIG. 1, so as to protrude in the front of the spectrometer. In side the slit box 26 is set a receiving slit which is a motor-driven variable aperture slit, but the slit may be an constant aperture slit.

On the top surface of the base 12 is fixed a pair of first guide rails 28 which extend lengthwise along the base 12 except on the portion to which the first brackets 22 and 24 are fixed. A first slide 30 is a horizontal plate and rides slidably on the first guide rails 28. The first slide 30 engages at its bottom with a first ball screw 32 which is connected to the output shaft of a first motor 34. The first motor 34 rotates to rotate the first ball screw 32 so that the first slide 30 slides along the first guide rails 28.

On the top surface of the first slide 30 is fixed a pair of second brackets 36 and 38 to which a post 40 is pivotally connected at its bottom. To the front-side second bracket 36 is pivotally connected a second arm 42 at its bottom to which a monochromator holder 44 is fixed. The monochromator holder 44 protrudes from, at a right angle to, the second arm 42 in the front of the spectrometer and fixedly holds the curved crystal monochromator 10.

The post 40 has a H-shaped cross section. To the front side of the post 40 is fixed a pair of second guide rails 46 to which a second slide 48 is slidably connected. The second slide 48 is a vertical plate and engages at its back with a second ball screw 50 connected to the output shaft of a second motor 52 which is mounted on the top of the post 40 and illustrated by a imaginary line. The second motor 52 rotates to rotate the second ball screw 50 so that the second slide 48 slides along the second guide rails 46. To the front surface of the second slide 48 is pivotally connected a third arm 54 at its top. The bottom of the third arm 54, the top of the first arm 25 and the top of the second arm 42 are pivotally connected to one another. The center of the pivotal connection coincides with the center O (FIG. 2) of the Rowland circle 11.

Referring back to FIG. 1, near the top end of the front surface of the second slide 48 is fixed an X-ray tube holder plate 56, illustrated by a imaginary line, which protrudes from the second slide 48 in the front of the spectrometer. An X-ray tube 58, also illustrated by a imaginary line, is fixed to the bottom surface of the X-ray tube holder plate 56. To the side edge of the second slide 48 is fixed a balance weight holder plate 60 which is bent at a right angle to make a bent portion whose back side fixedly supports a balance weight 62 for balancing with the weight of the X-ray tube 58. The X-ray tube 58 and the balance weight 62 give, to the post 40, approximately the same amount of bending moment in the opposite directions.

Almost all the weight of the X-ray spectrometer is supported by the base 12 which is to support all of an X-ray tube movement mechanism including the post 40, the second guide rails 46, the second slide 48, the second ball screw 50 and the second motor 52; and a curved crystal monochromator movement mechanism including the first guide rails 28, the first slide 30, the first ball screw 32 and the first motor 34. On the other hand, the prior-art XAFS apparatus has a comparatively large baseplate parallel to the Rowland circle for supporting any guide rails and any drive motors, as disclosed in, for example, Japanese Patent Publication Nos. JP 6-66736 A (1994) and JP 6-66738 A (1994) cited hereinbefore. The X-ray spectrometer shown in FIG. 1 has not such a large baseplate but the comparatively small and long base 12 which is arranged below and supports the X-ray tube movement mechanism and the curved crystal monochromator movement mechanism, so that the spectrometer can be compact.

Referring to FIG. 2, the focal spot F of the X-ray tube 58, the reflective surface of the curved crystal monochromator 10 and the receiving slit RS are positioned on the Rowland circle 11. A continuous X-ray beam from the focal spot F of the X-ray tube 58 passes through the divergence slit DS, mounted on the second slide 48, to be restricted in divergence angle and then is incident upon the curved crystal monochromator 10. With the angle of incidence θ of the incident X-ray beam with respect to the reflective surface of the monochromator 10, only a monochromatic X-ray beam of a selected wavelength, which satisfies the Bragg's law with the angle of incidence θ, is reflected by the monochromator 10 and focused on the receiving slit RS. This figure shows a state in which the angle of incidence θ is 45 degrees, i.e., 2θ is 90 degrees, and therefore the post 40 is in the vertical position. In this embodiment, the Rowland circle 11 has a radius of 320 mm and each of the three arms 25, 42 and 54 also has an effective length of 320 mm, the effective length being defined as a distance between the two pivot centers positioned near the both ends of each arm. It is noted that such a X-ray spectrometer structure using three pivotal arms of the same length along with the two translational slides is known (see Japanese Patent Publication No. JP 6-151089 (1994)). The known X-ray spectrometer, however, has an X-ray source which remains stationary, while a curved crystal monochromator and a receiving slit both are movable.

The X-ray tube 58 is of a demountable and stationary anode type and has a turbo-molecular pump 59 (not shown) connected thereto to evacuate the inside of the X-ray tube 58. The X-ray tube 58, however, may be of a rotating anode type or a sealed-off type.

Figure 3:
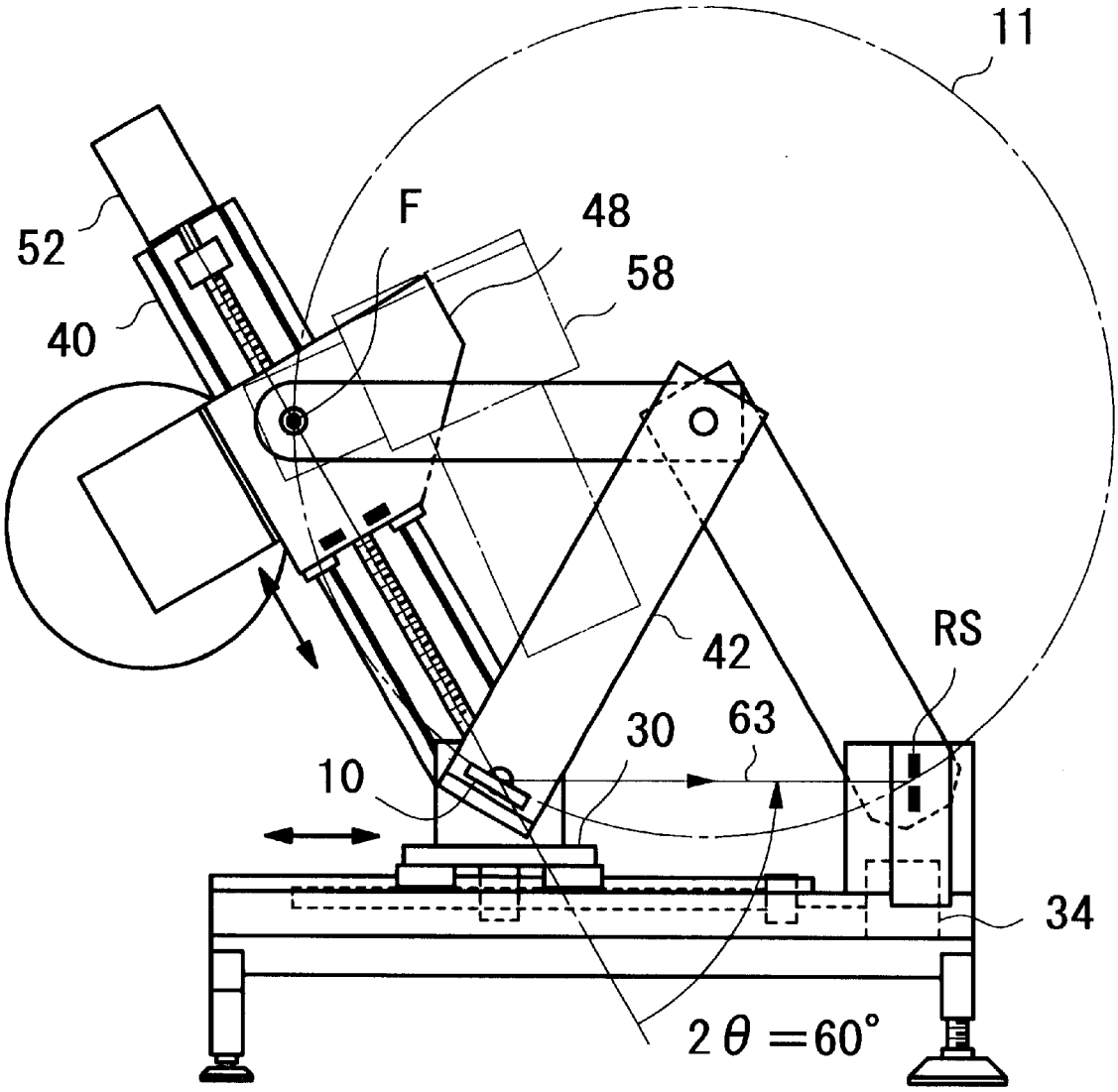
FIG. 3 is an elevation view illustrating another state in which the angle of incidence of an X-ray beam with respect to the monochromator changes from the state shown in FIG. 2.

Referring now to FIG. 3, it shows another state in which the angle of incidence θ of an X-ray beam with respect to the monochromator 10 changes, from the state shown in FIG. 2, to be 30 degrees, i.e., 2θ is 60 degrees. For obtaining this state, the first slide 30 is moved rightward in FIG. 2 by a predetermined distance and at the same time the second slide 48 is moved downward along the post 40 by the same distance. For carrying out this movement, the first motor 34 is driven to rotate by a predetermined amount and, at the same time, the second motor 52 is driven to rotate by a predetermined amount. The first motor 34 and the second motor 52 are pulse motors which can precisely control the positions of the first slide 30 and the second slide 48 by regulating the number of pulses. The motors 34 and 52 may be DC servomotors or AC servomotors. Also in the state shown in FIG. 3, the focal spot F of the X-ray tube 58, the reflective surface of the curved crystal monochromator 10 and the receiving slit RS are positioned on the Rowland circle 11, provided that the Rowland circle 11 has moved as compared with FIG. 2. Since the curved crystal monochromator 10 is mounted on the second arm 42, the monochromator 10 rotates so as to face always the center of the Rowland circle 11 as the second arm 42 rotates. At the same time, the curved crystal monochromator 10 moves right and left in FIG. 3 as the first slide 30 moves. This movement is so controlled that the distance between the focal spot F of the X-ray tube 58 and the center of the curved crystal monochromator 10 is always equal to the distance between the center of the curved crystal monochromator 10 and the receiving slit RS.

As well understood by comparing the two states shown in FIGS. 2 and 3, the receiving slit RS of this X-ray spectrometer remains perfectly stationary even when the curved crystal monochromator 10 and the X-ray tube 58 are in motion to change the X-ray wavelength. Furthermore, the X-ray path 63 extending from the curved crystal monochromator 10 to the receiving slit RS has the constant direction, i.e., which does not change at all. These advantageous features lead to that a sample and any X-ray detectors of the XAFS apparatus, to be positioned behind the receiving slit, require no their movement at all during the wavelength change of an X-ray beam taken out from the X-ray spectrometer.

Figure 4:
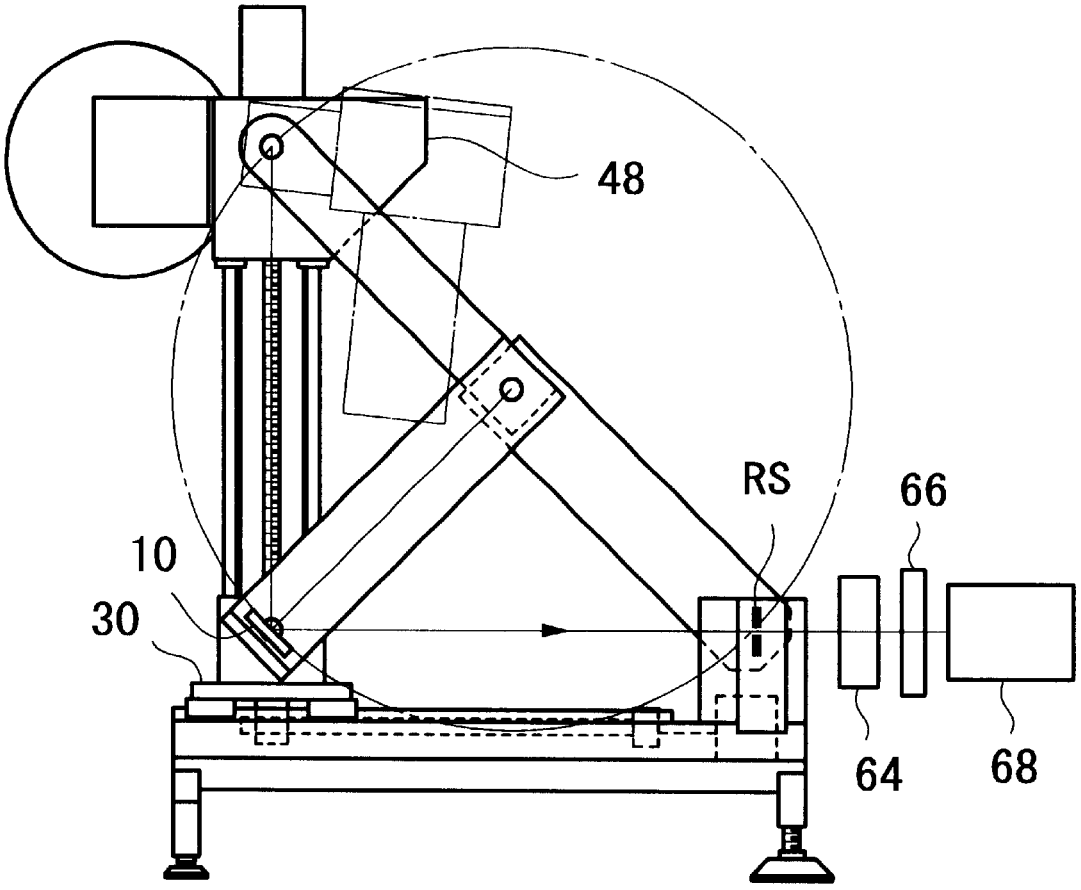
FIG. 4 is an elevation view of XAFS apparatus using, as an X-ray irradiation system, the X-ray spectrometer shown in FIG. 1.

Referring next to FIG. 4, it shows XAFS apparatus using the X-ray spectrometer. Behind (rightward in FIG. 4) the receiving slit RS of the X-ray spectrometer are disposed a transmission proportional counter 64, which is the first X-ray detector, a sample 66 and a scintillation counter 68, which is the second X-ray detector, in the described order. An X-ray beam having passed through the receiving slit RS passes through the transmission proportional counter 64, passes through the sample 66 and reaches the scintillation counter 68. An X-ray intensity before passing through the sample 66 is detected by the transmission proportional counter 64 and an X-ray intensity after passing through the sample 66 is detected by the scintillation counter 68. The two detected intensities are compared with each other to obtain an X-ray absorption coefficient of the sample 66. The first slide 30 and the second slide 48 are moved so as to change the angle of incidence θ of an X-ray beam from the X-ray source with respect to the monochromator 10 to produce a monochromatic X-ray beam of a different wavelength. The X-ray absorption coefficients of the sample 66 are measured for different wavelengths to obtain an X-ray absorption spectrum of the sample 66. The first X-ray detector may be an ionization chamber or a silicon PIN diode instead of the transmission proportional counter. The second X-ray detector may be a propotional counter or an SSD (solid-state detector).

The XAFS apparatus shown in FIG. 4 differs from the prior-art XAFS apparatus typically in that the transmission proportional counter 64, the sample 66 and the scintillation counter 68 all remains perfectly stationary during measurements of X-ray absorption spectra on the sample 66. Hence, the X-ray spectrometer, which is an X-ray irradiation system of the XAFS apparatus, and a group consisting of the sample and the two X-ray detectors, which is an X-ray measurement system of the XAFS apparatus, are managed independently. Therefore, even if the sample and/or the detectors would have large sizes and weights, the X-ray spectrometer would not be affected at all. In other words, the sample and the detectors can be selected with the least restriction as compared with the prior-art XAFS apparatus.

Figure 5:
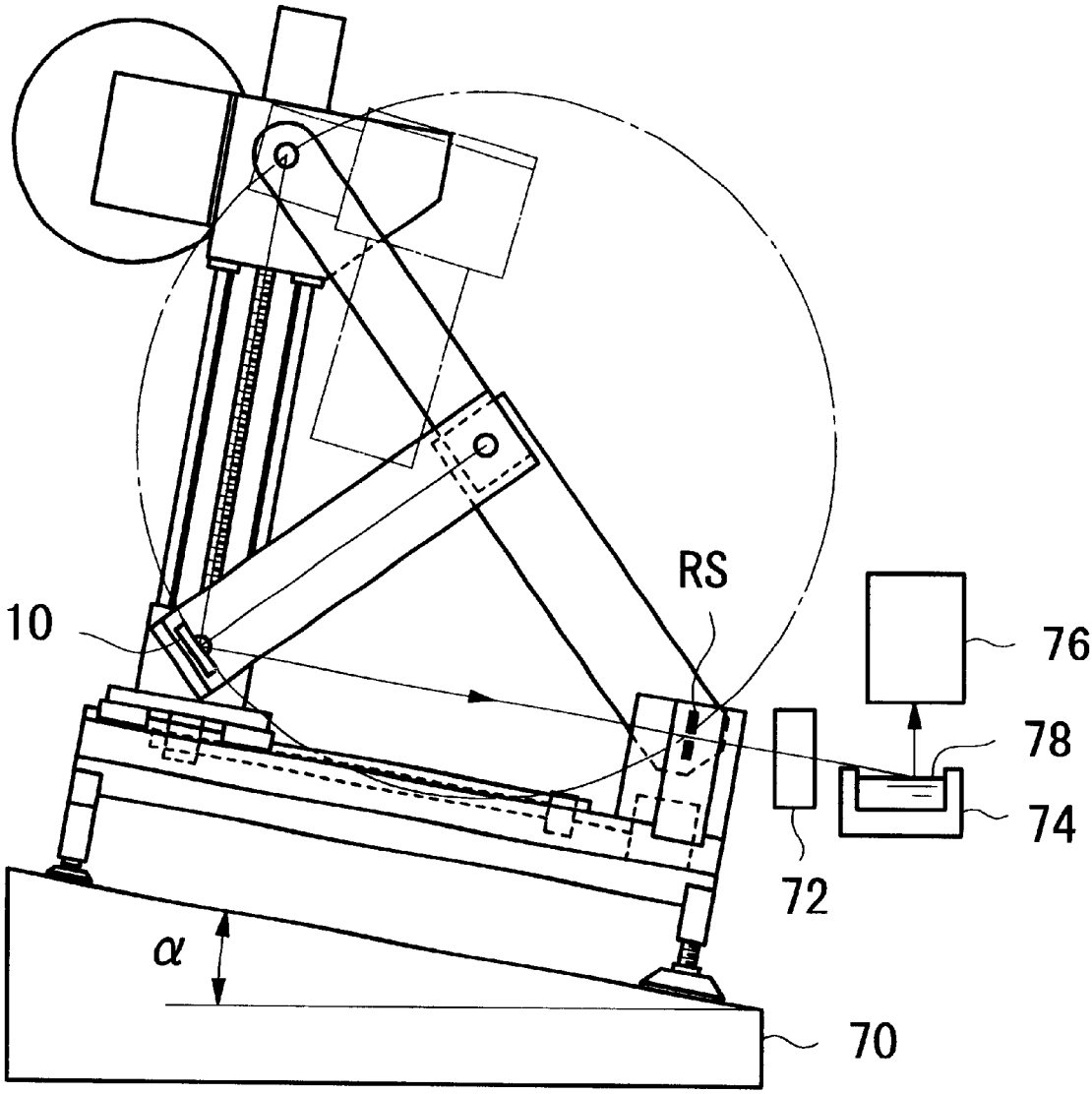
FIG. 5 is an elevation view of another XAFS apparatus using, as an X-ray irradiation system, the X-ray spectrometer shown in FIG. 1.

Referring next to FIG. 5, it shows fluorescent XAFS apparatus for a horizontal sample in which the whole X-ray spectrometer is inclined from the horizontal by an angle α. The X-ray spectrometer rests on an inclined platform 70 whose top surface is inclined from the horizontal by the angle α which is 10 degrees in this embodiment. Therefore, the X-ray path extending from the center of the curved crystal monochromator 10 to the receiving slit RS is inclined from the horizontal by 10 degrees. Instead of using the inclined platform 70, the first support legs 18 shown in FIG. 1 may be adjustable in height so as to lift the first support plate 14 to incline the base 12 per se.

Referring back to FIG. 5, behind the receiving slit RS are arranged a transmission X-ray detector 72, which is the first X-ray detector, a vessel 74 for liquid samples and an X-ray detector 76, which is the second X-ray detector. The X-ray beam having passed through the receiving slit RS passes through the transmission X-ray detector 72 and then is incident upon the liquid surface, which is horizontal, of the liquid sample 78 in the vessel 74 with an angle of 10 degrees. A fluorescent X-ray beam generates from the liquid sample 78 and is detected by the X-ray detector 76. Since the vessel 74 remains stationary during measurements of an absorption spectrum in this XAFS apparatus, there does not occur such a problem as waving of the surface of the liquid sample 78. Further, since the X-ray beam is incident upon the surface of the liquid sample 78 with always the same angle, there does not occur such another problem that the irradiation area size on the sample changes as the X-ray wavelength changes.

Figure 6:
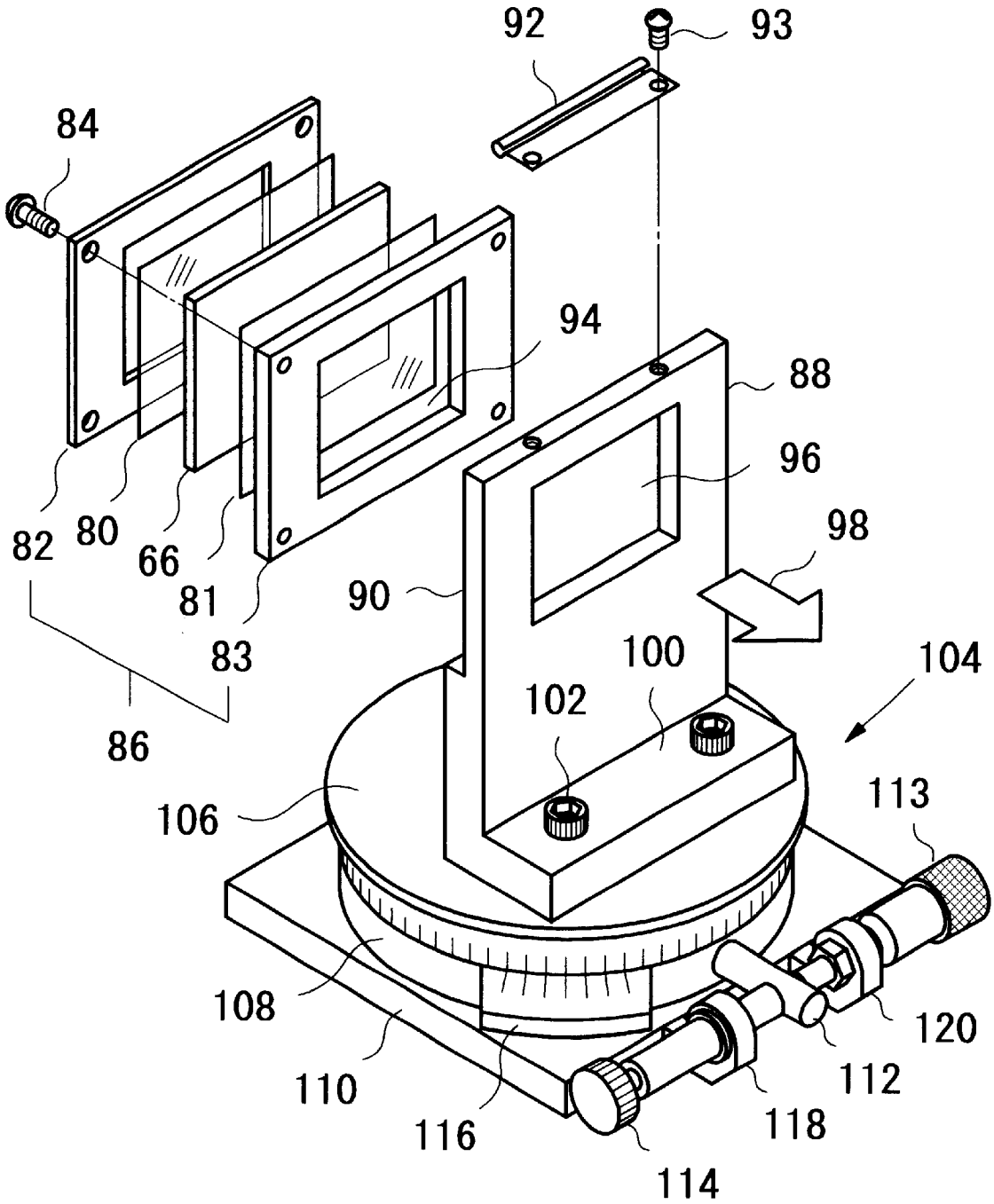
FIG. 6 is a perspective view of a sample holder used for the XAFS apparatus shown in FIG. 4.
Figure 7:
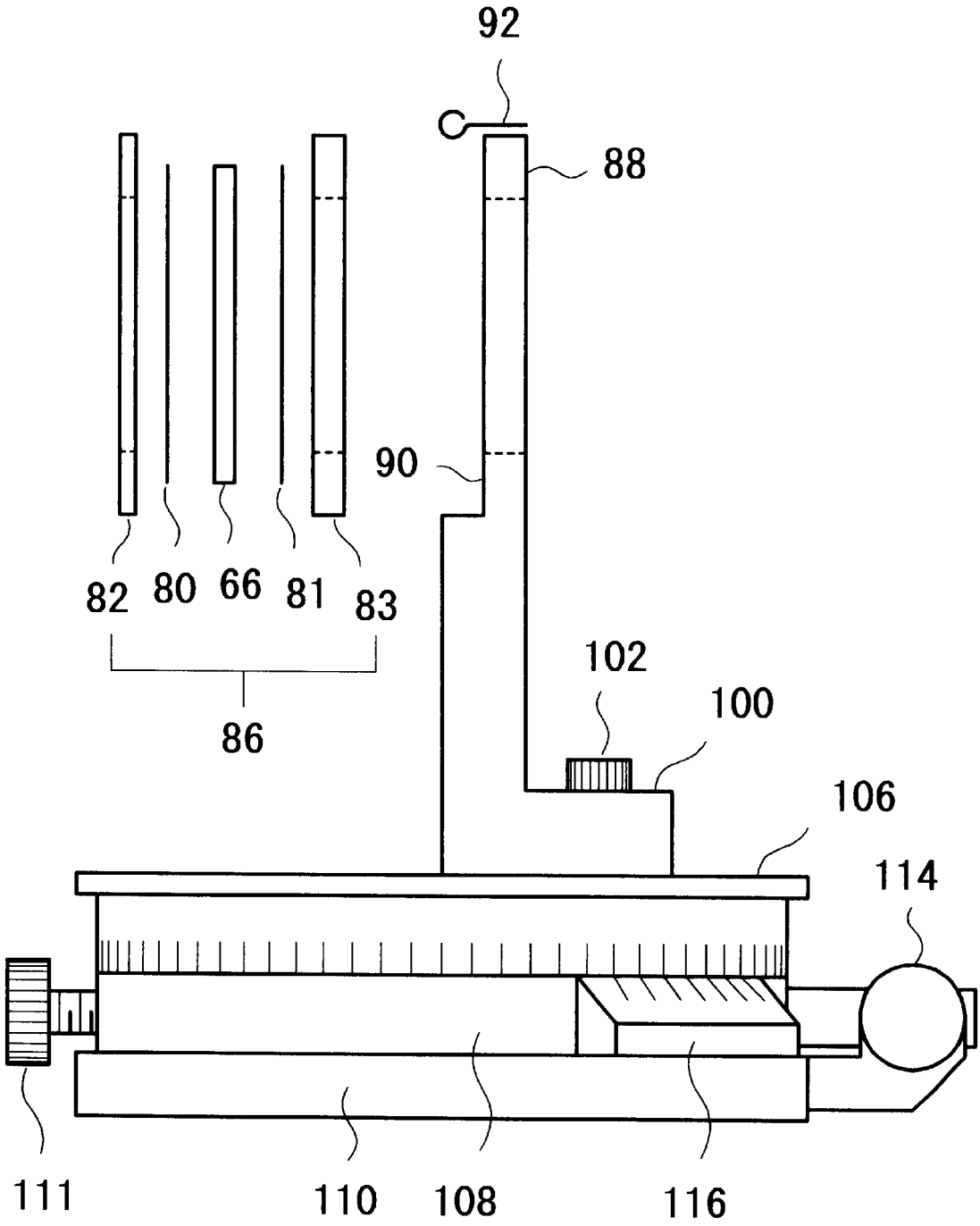
FIG. 7 is an elevation view of the sample holder shown in FIG. 6.

Referring now to FIGS. 6 and 7, they shows a sample holder used for the XAFS apparatus shown in FIG. 4. The sample holder includes, as main parts, a pair of hold frames 82 and 83, a hold plate 88 and a rotary platform 104. A plate-like sample 66 is held between two poly(ethylene terephthalate) films 80 and 81 and further held between a pair of the hold frames 82 and 83, the first hold frame 82 being thin and the second hold frame 83 being thick. The two hold frames 82 and 83 are fastened to each other by four screws 84 to obtain an sample assembly 86 which is to be mounted on a recess 90 of the hold plate 88. The hold plate 88 stands upright and has the recess 90 near its top to have a thin portion. To the top of the hold plate 88 is fixed a leaf-spring-like hold spring 92 by two screws 93. In a mounting operation, the sample assembly 86 is held with the second hold frame 83 facing the hold plate 88 and pushed against the recess 90 so that the top of the second hold frame 83 is pushed downward by the hold spring 92, resulting in the sample assembly 86 fixed to the hold plate 88. Each of the hold frames 82 and 83 has a window 94 for an X-ray beam 98 passing therethrough and the hold plate 88 also has a similar window 96.

The hold plate 88 has, at its bottom, a mounting portion 100 which is fixed, by two screws 102, to the top surface of a coarse adjustment stage 106 of the rotary platform 104. The rotary platform 104 can rotate around an axis of rotation extending vertically to adjust the direction of the hold plate 88 so that the sample 66 on the hold plate 88 is properly perpendicular to the X-ray beam 98. The rotary platform 104 has at its top the circular coarse adjustment stage 106 which rests on a circular fine adjustment stage 108. The coarse adjustment stage 106 has a cylindrical flank on which a scale is marked all around. When a coarse-adjustment-clamp screw 11 (FIG. 7) is loosened, the coarse adjustment stage 106 can be manually turned to be adjusted in angular position with respect to the fine adjustment stage 108 within a range of angle of ±180 degrees. When the coarse-adjustment-clamp screw 111 is fastened, the coarse adjustment stage 106 is fixed to the fine adjustment stage 108 to unite with the stage 108.

The fine adjustment stage 108 has a cylindrical flank from which a bar 112 protrudes. When a fine-adjustment-clamp screw 114 is loosened and a micrometer head 113 is turned to push the bar 112 horizontally, the fine adjustment stage 108 is slightly turned to be adjusted in angular position with respect to a base 110 within a range of angle of ±3 degrees. When the fine adjustment stage 108 is slightly turned, the coarse adjustment stage 106 is also slightly turned along with the stage 108 because the stages 106 and 108 are united. When the fine-adjustment-clamp screw 114 advances, the bar 112 is locked in position between the micrometer head 113 and the clamp screw 114 to lock the fine adjustment stage 108 with respect to the base 110. The micrometer head 113 and the fine-adjustment-clamp screw 114 are supported by brackets 118 and 120 fixed to the base 110. As well described above, the hold plate 88 on the coarse adjustment stage 108 is adjusted in angular position with respect to the base 110, its angular position being precisely readable using a vernier scale 116 fixed to the base 110. The base 110 may be fixed by any screw means or the like to a base frame of the XAFS apparatus or may rest on such a base frame. Completing the above-described sample adjustment operation in which the rotary platform 104 is adjusted to rotate in angular position so that the surface of the sample 66 becomes perpendicular to the X-ray beam 98, the XAFS measurements are carried out with the sample 66 remaining stationary.

Figure 8:
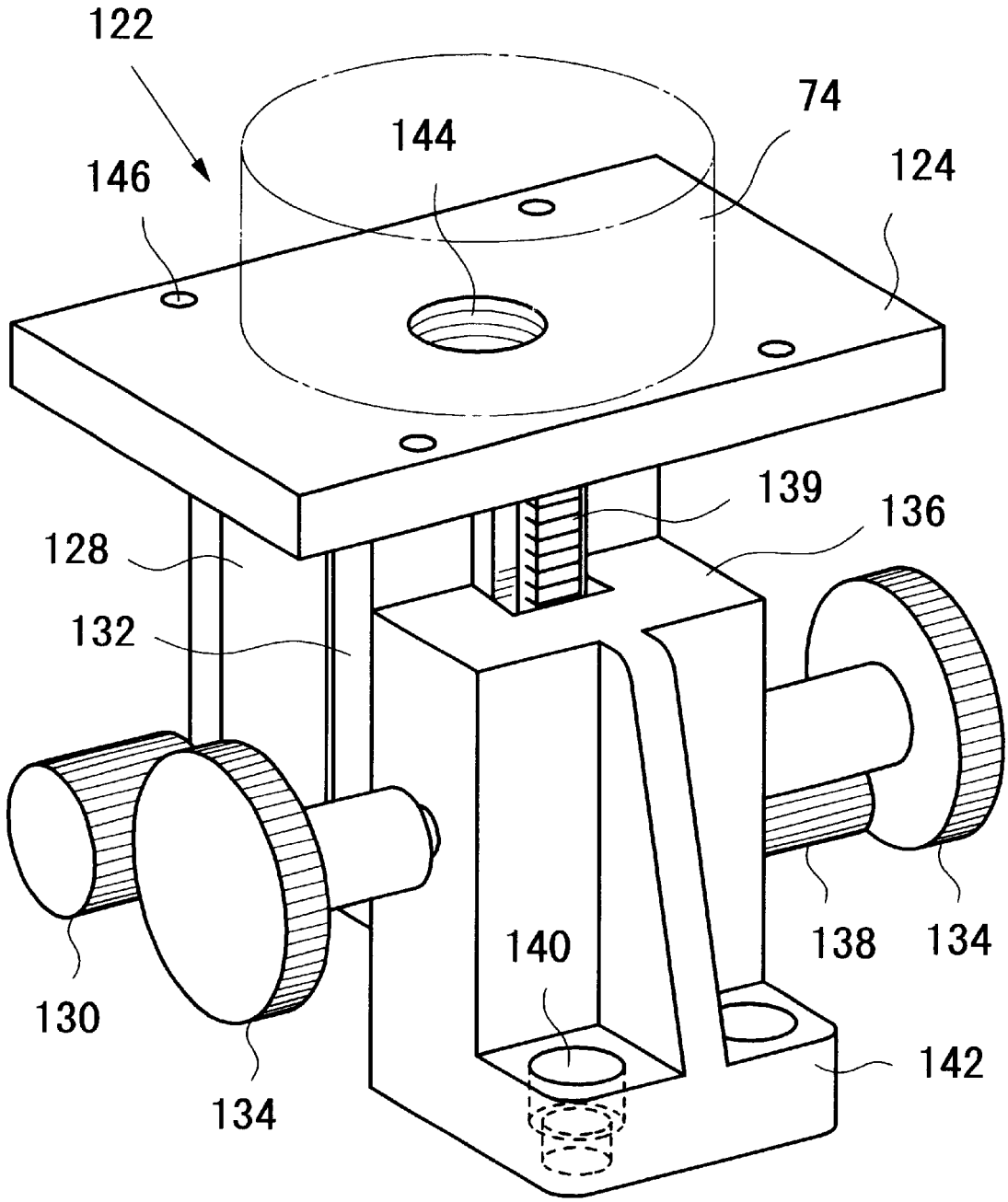
FIG. 8 is a perspective view of a sample holder used for the XAFS apparatus shown in FIG. 5.

Referring next to FIG. 8, it shows a sample holder used for the XAFS apparatus shown in FIG. 5. The sample holder 122 can adjust the sample in height. A support table 124 has a horizontal top surface on which the vessel 74 for liquid samples is to rest. Since the top surface of the support table 124 has a plurality of threaded bores 144 and 146, any sample holder could be fixed to the table 124 with the use of the threaded bores. The support table 124 is fixed to the top of a fine adjustment stage 128 which is movable vertically with respect to a coarse adjustment stage 132 within a range of a predetermined small distance. When the fine adjustment handle 130 is turned, the fine adjustment stage 128 is moved vertically, by a cam mechanism, with respect to the coarse adjustment stage 132 within a range of 2 mm. Further, the coarse adjustment stage 132 is movable vertically with respect to a base 136. When a clamp screw 138 is loosened and then coarse adjustment handles 134, one at the left and the other at the right, are turned, the coarse adjustment stage 132 is moved vertically, by a rack-pinion mechanism, with respect to the base 136 within a range of 20 mm. The coarse adjustment stage 132 has a flank to which a rack 139 is fixed, the rack 139 engaging with a pinion connected to the coarse adjustment handles 134. The coarse adjustment stage 132 is guided, by a dovetail groove, for vertical movement with respect to the base 136. When the clamp screw 138 is fastened, the coarse adjustment stage 132 is locked to the base 136. Thus, the coarse adjustment handles 134 and the fine adjustment handle 130 are operated to adjust the height of the support table 124 precisely. The base 136 has, at its bottom, a mounting portion 142 having two counterbored through holes 140 through which any bolt means can be inserted so as to fasten the base 136 to a stationary base frame or the like of the XAFS apparatus. Completing the above-described height adjustment operation in which the support table 124 is adjusted in height so that an X-ray beam is incident properly upon the surface of the sample on the support table 124, the fluorescent XAFS measurements are carried out, as shown in FIG. 5, with the sample remaining stationary.

What is claimed is:

1. An X-ray spectrometer comprising:

an X-ray source;

a curved crystal monochromator;

a receiving slit; and a movement control mechanism in which an angle of incidence of a continuous X-ray beam from said X-ray source can be changed with respect to said monochromator so that a monochromatic X-ray beam of a different desired wavelength can be focused on and taken out from said receiving slit, provided that said X-ray source, said monochromator and said receiving slit must be positioned always on a Rowland circle, wherein said X-ray source and said curved crystal monochromator can be moved so that said angle of incidence changes, while said receiving slit remains stationary and a direction of an X-ray path from the center of said curved crystal monochromator to said receiving slit remains always constant during a change of said angle of incidence.

2. An X-ray spectrometer according to claim 1, wherein said Rowland circle is arranged within a vertical plane, and said movement control mechanism includes a movement mechanism for X-ray source and a movement mechanism for monochromator, said two movement mechanisms being supported by a horizontal long base which is positioned below said two movement mechanisms.

3. An X-ray spectrometer according to claim 2, wherein said movement mechanism for monochromator has a horizontal first slide which slides along first guide rail means on said base, said curved crystal monochromator being set so as to move along with said first slide, while said movement mechanism for X-ray source has a post pivotally connected to said first slide and a second slide which slides along second guide rail means fixed to said post, said X-ray source being fixed to said second slide.

4. Apparatus for XAFS measurements comprising:

an X-ray irradiation system consisting of an X-ray spectrometer which includes an X-ray source, a curved crystal monochromator, a receiving slit, and a movement control mechanism in which an angle of incidence of a continuous X-ray beam from said X-ray source can be changed with respect to said monochromator so that a monochromatic X-ray beam of a different desired wavelength can be focused on and taken out from said receiving slit, provided that said X-ray source, said monochromator and said receiving slit must be positioned always on a Rowland circle, wherein said X-ray source and said curved crystal monochromator can be moved so that said angle of incidence changes, while said receiving slit remains stationary and a direction of an X-ray path from the center of said curved crystal monochromator to said receiving slit remains always constant during a change of said angle of incidence; and an X-ray measurement system including a first X-ray detector for detecting an X-ray beam taken out from said X-ray irradiation system and a second X-ray detector for detecting (a) an X-ray beam having passed through said first X-ray detector and a sample or (b) a fluorescent X-ray beam generating from a sample.

5. Apparatus for XAFS measurements according to claim 4, wherein said Rowland circle is arranged within a vertical plane, and said movement control mechanism includes a movement mechanism for X-ray source and a movement mechanism for monochromator, said two movement mechanisms being supported by a horizontal long base which is positioned below said two movement mechanisms.

6. Apparatus for XAFS measurements according to claim 5, wherein said movement mechanism for monochromator has a horizontal first slide which slides along first guide rail means on said base, said curved crystal monochromator being set so as to move along with said first slide, while said movement mechanism for X-ray source has a post pivotally connected to said first slide and a second slide which slides along second guide rail means fixed to said post, said X-ray source being fixed to said second slide.

7. Apparatus for XAFS measurements according to claim 4, wherein said X-ray measurement system includes a sample holder which can support said sample in a stationary condition during XAFS measurements.

* * * * *